US006664938B2

(12) United States Patent
Strickland

(10) Patent No.: US 6,664,938 B2
(45) Date of Patent: Dec. 16, 2003

(54) PENTAGONAL HELICAL ANTENNA ARRAY

(75) Inventor: Peter C. Strickland, Ottawa (CA)

(73) Assignee: EMS Technologies Canada, Ltd., Ottawa (CA)

( * ) Notice: Subject to any disclaimer, the term of this patent is extended or adjusted under 35 U.S.C. 154(b) by 34 days.

(21) Appl. No.: 10/085,049

(22) Filed: Mar. 1, 2002

(65) Prior Publication Data

US 2003/0164805 A1 Sep. 4, 2003

(51) Int. Cl.[7] ..... H01Q 1/36
(52) U.S. Cl. ..... 343/895; 343/853
(58) Field of Search ..... 343/895, 853, 343/867, 866, 846, 829; H01Q 1/36

(56) References Cited

U.S. PATENT DOCUMENTS

| | | | | |
|---|---|---|---|---|
| 4,119,972 A | | 10/1978 | Fletcher et al. | |
| 4,123,759 A | | 10/1978 | Hines et al. | |
| 4,427,984 A | * | 1/1984 | Anderson | 343/764 |
| 5,094,046 A | * | 3/1992 | Preiswerk | 52/108 |
| 5,231,413 A | * | 7/1993 | Dubois | 343/833 |
| 5,345,248 A | * | 9/1994 | Hwang et al. | 343/895 |
| 5,587,719 A | | 12/1996 | Steffy | |
| 5,999,145 A | | 12/1999 | Niekamp | |
| 6,114,998 A | * | 9/2000 | Schefte et al. | 343/700 MS |
| 6,115,005 A | | 9/2000 | Goldstein et al. | |
| 2003/0085846 A1 | * | 5/2003 | Killen | 343/844 |

FOREIGN PATENT DOCUMENTS

| | | |
|---|---|---|
| CA | 971 643 | 7/1975 |
| CA | 2 030 600 | 11/1991 |
| CA | 2 196 667 | 3/1996 |

OTHER PUBLICATIONS

Antenna Engineering Handbook, Third Edition, Richard C. Johnson, Georgia Institute of Technology, Atlanta, Georgia.

* cited by examiner

*Primary Examiner*—Tho Phan
(74) *Attorney, Agent, or Firm*—Shapiro Cohen; Dennis R. Haszko

(57) ABSTRACT

A pentagonal antenna array having a high aperture efficiency and a suitably high overall gain and low antenna noise temperature. The high aperture efficiency of this antenna system provides an overall system capacity suitable for broadband communication services. The antenna array consists of five antenna elements each located at a separate vertex of a pentagon. The antenna elements are helical antennas to provide a narrow antenna beam width. The antenna array itself is supported on a base platter which may be steered to point at a satellite using conventional gimbal ring apparatus. The base platter is a planar reflector to reflect the antenna element radiation in the rear direction and thereby reduce the antenna backlobe levels. The input power and the signal transmitted are fed through a phasing/combining network. The phasing/combining network appropriately divides the signal and the input power and phases the signal, prior to feeding the signal to each of the five antenna elements.

9 Claims, 5 Drawing Sheets

PENTAGONAL HELICAL ANTENNA ARRAY

FIELD OF THE INVENTION

The present invention relates to a phased-array antenna for both ground and airborne satellite communications. More particularly, the invention relates to such an array of antenna elements which are disposed in a pentagonal configuration.

BACKGROUND TO THE INVENTION

Modem aircraft travel through great distances, often over open water and far from the reach of most conventional communications services. Satellite communications have became crucial to pilots when navigating an aircraft, receiving weather reports and air traffic control information, as well as communicating status and emergency messages. Satellite communication systems located on aircraft provides a means for communication while the aircraft is airborne or on the ground. In addition, satellite communication systems are useful in providing such services as telephone communication, Internet services, and other forms of data exchange to the aircraft passengers. In order to provide these additional services to the aircraft passenger, the satellite antenna system must receive these services through receipt of sufficient amounts of data per unit of time.

The amount of data per unit of time, hereinafter data rate, that the satellite antenna system may support increases as the effective aperture area of the satellite antenna increases. Essentially, the signals originating from the satellite may be received at a higher data rate when the effective aperture area is increased. For aircraft-satellite communication purposes, one requirement is that the aperture efficiency of the aircraft antenna must be suitable to receive a high data rate to provide the communication services required. The aperture efficiency may be defined as the ratio between the physical dimensions of the antenna array and the effective aperture area of the antenna array. A high aperture efficiency implies that this ratio is close to unity.

The aperture efficiency is an important design consideration for satellite antennas placed in the tail section of modern aircraft. The tail sections of modern aircraft tend to be very narrow and, consequently, there is a limit to the size of antenna that can be placed in this tail section. In, order to compensate for the size limitation, the aperture efficiency of the antenna must be increased. Another design consideration is that, typically, the antenna will be mechanically steered within the tail of the aircraft in order to scan the coverage required. This additional movement demands that the diameter of the antenna be small enough so that the antenna fits within a radome covering the top portion of the aircraft tail section.

One solution to the above requirements is the use of mechanically-steered phased-array antennas. Phased-array antennas have been markedly suitable for aircraft purposes. These antennas can, in some cases, have a high aperture efficiency and permit the antenna beam to be directed at various satellites regardless of aircraft orientation. The mechanically-steered phased-array antenna consists of a group of antenna elements that are distributed and oriented on a planar surface in various spatial configurations. The amplitude and phase excitation of each antenna element is fixed since the beam is pointed mechanically.

U.S. Pat. No. 4,123,759, issued to Hines et al., discloses a phased-array antenna where at least three radiating elements are located at the corners of regular polygon. According to Hines, the preferred embodiment for radio communications is a square-array. The crux of Hines teaching is in maximizing the radiation in one of four primary directions to achieve omni-directional coverage around the horizon. However, one shortcoming of Hines is that the preferred polygon configuration is not ideal for satellite antenna applications where aperture efficiency is critical for providing communication services. Furthermore, the antenna elements described by Hines have a very broad beam width thus limiting the antenna's gain. The broad beam width, however, is a hindrance in satellite applications where the maximum gain possible is required.

U.S. Pat. No. 6,115,005, issued to Goldstein et al., teaches a helical antenna arrangement including a large number, 36 in the preferred embodiment, of helical antenna elements with axes parallel to the antenna boresight axis. The antenna elements have a spatially aperiodic distribution. The mutual spacing between any two antenna elements of the array is at least twice the wavelength of the operating frequency of the antenna. The antenna elements are converted to a signal distribution unit which contains a signal network through which the antenna beam or radiation pattern is controlled.

The present invention provides an antenna array of helical elements having a pentagonal configuration with exceptionally high aperture efficiency and low swept volume for a given gain. The antenna elements belonging to the antenna array should have very narrow beams and be fixed in position and connected to a phasing/combining network. Furthermore, the present invention provides an antenna array suitable for mounting in the tail section of an aircraft for satellite communications.

SUMMARY OF THE INVENTION

The present invention provides a pentagonal antenna array having a high aperture efficiency and a suitably high overall gain and low antenna noise temperature. The high aperture efficiency of this antenna system provides an overall system capacity suitable for broadband communication services. The antenna array consists of five antenna elements each located at a separate vertex of a pentagon. The antenna elements are helical antennas to provide a narrow antenna beam width. The antenna array itself is supported on a base platter which may be steered to point at a satellite using conventional gimbal ring apparatus. The base platter is a planar reflector to reflect the antenna element radiation in the rear direction and thereby reduce the antenna backlobe levels. The input power and the signal transmitted are fed through a phasing/combining network. The phasing/combining network appropriately divides the signal and the input power and phases the signal, prior to feeding the signal to each of the five antenna elements.

The antenna elements are positioned at the points of a pentagon, which are 72° apart, around the antenna base. Adjacent elements have a 72° relative angular rotation and a compensating 72° relative excitation phase in order to ensure that the elements are all radiating in phase, which results in very uniform excitation of the entire volume of the antenna and the elimination of polarisation loss. Each helical antenna element launches an axial wave that is circularly polarised. The individual helices are angularly displaced 72° and the phase of the current provided to the windings is sequentially offset by 72° such that the radiated fields are in phase. This sequential "displacement" virtually eliminated polarisation loss by avoiding the alignment of the principal axes of the individual polarisation ellipses. The individual helices positioning is arranged that each one has a direction 72° from the position of its neighbours. If they were fed in phase their radiated signals would be out of phase. But by feeding them 72° from their neighbours their radiated signals are in phase.

In a first aspect, the present invention provides an antenna system comprising:

a base;

five helical antenna elements mounted on said base, each antenna element having a base end and a terminal end and being located at a separate vertex of a pentagon, and each element further having an antenna element feed connected at the base end thereof; and a phasing/combining network for feeding input power to each antenna element feed;

wherein each of the elements is supported by the base at the base end of each antenna element.

In a second aspect, the present invention provides an antenna system comprising:

a base having a planar surface;

five helical antenna elements mounted on said base with their helix axes orthogonal to the plane surface of the base, each of the helical antenna elements being located at a separate vertex of a pentagon, and each element having an antenna element feed located at a base end of the element; and a phasing/combining network for feeding input power to each antenna element.

In a third aspect, the present invention provides an antenna system including:

a base having a planar surface;

five multi-filar helical antenna elements mounted on said base with their helix axes orthogonal to the planar surface of the base, each of the elements being located at a separate vertex of a pentagon, each of the five multi-filar helical antenna elements having a feed network coupled to a base end thereof and each feed network having a feed end located at the base end of a corresponding element; and a phasing/combining network for connecting the feed network of each element;

wherein each element is supported by the base at the base end of the element, and wherein the phasing/combining network feeds input power to the feed end of each feed network.

In a fourth aspect, the present invention provides an antenna system comprising:

a base having a planar surface;

five helical antenna elements mounted on said base with their helix axis orthogonal to the planar surface of the base, each of the five helical antenna elements being located at a separate vertex of a pentagon, each of the five helical antenna elements being angularly displaced by 72° relative to its two adjacent elements, each of the five helical antenna elements having a feed network coupled to a base end of the helical antenna element, and each feed network having a feed end located at the base end of a corresponding helical antenna element, the feed network exciting the elements with relative phases of 0°, 72°, 144°, 216°, 288° or 0°, −72°, −144°, and −288°.

BRIEF INTRODUCTION TO THE DRAWINGS

The present invention will now be described with reference to the drawings, in which.

DETAILED DESCRIPTION:

FIGS. 1–4 are the various views of a pentagonal antenna array according to one embodiment of the present invention.

Figure 1:
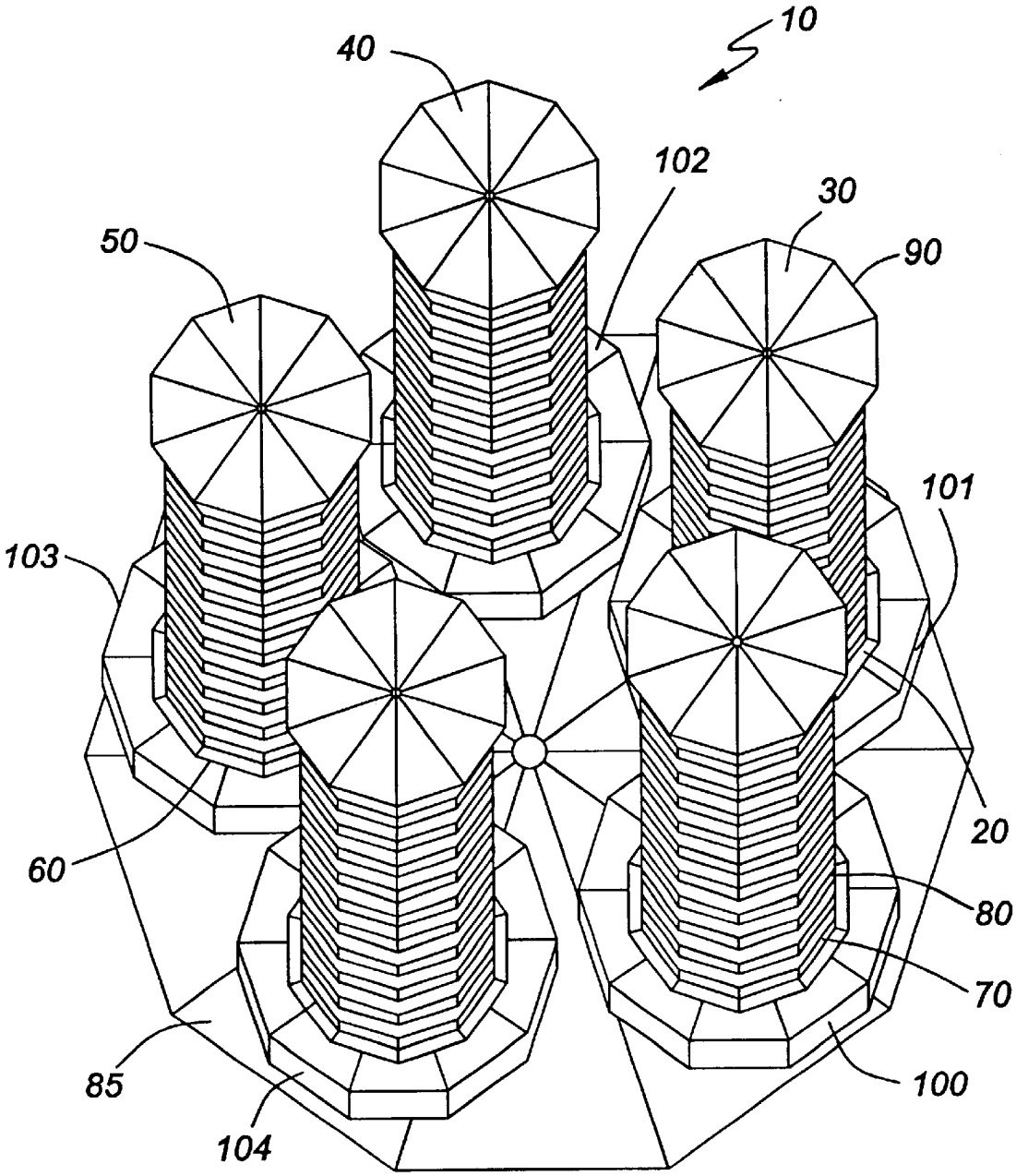
FIG. 1 is an isometric view of a pentagonal array according to a first embodiment of the present invention.

FIG. 1 illustrates an isometric view of the antenna system 10. The antenna elements shown are five mono-filar helical antenna elements, 20, 30, 40, 50, 60. A mono-filar helical antenna element consists of a conductive filament helically wound around a support structure 80. The support structure shown is a cylindrical non-conducting tube but other suitable support structure designs are possible. As can be seen in FIG. 1, each mono-filar helical antenna element is identical. The element 20 has a conductive filament 70 that is wound around the support structure 80. A better illustration of the support structure is shown in FIG. 4. At the base end of the support structure there is a base end of the conductive filament 70 where current is fed. The filament 70 has its own feed (not shown) which is a conductive element, such as electrical wire or strip. Each filament feed belonging to the five helical antenna elements 20, 30, . . . , 60 is connected to a phasing/combining network, shown in FIG. 3. The support structures 80, are attached to a base platter 85. The base platter 85 has a reflective surface suitable for providing a return path for current flowing through each of the helical antenna elements 20, 30, . . . , 60, as well as reflecting radiation from the rear direction thus reducing the antenna system backlobe level. The reflective surface of the base platter 85 is capable of reflecting radio frequency waves.

In FIG. 1, other optional elements are illustrated. A conductive end-loading disc 90 is electrically connected to a terminal end of the helical filament. Basically, the terminal end is the end of the conductive filament located at the base 80. The end loading disc 90, connected to the helical antenna element 30, is one of five end-loading discs shown. The end-loading disc 90 improves the current distribution on the helix resulting in higher gain from the antenna element 30. As each end-loading disc 90 is conductive, the end-loading discs allow a finite current to flow on the ends of conductive filaments. The use of an end-loading disc increases the gain of not only each helical antenna element but also of the overall antenna system. The discs also ensure that the entire length of a particular antenna element is suitably resonant by allowing current to flow through the entire antenna element.

Another optional element is a reflector cup 100, . . . , 104 at the base end of the support structure for each antenna element. Although the antenna system does not require reflector cups, their use has significant advantages. The reflector cups, made of metallic material, provide an optional return path for current flowing into the helical antenna elements in the absence of a planar reflector beneath the cups. The reflector cups also reduce the effects of radiation energy transferred from one antenna element to another, known commonly as coupling. The reduced coupling effects in turn increase the gain of the individual helical antenna elements, at some frequencies. If the cup is optimized radiation from the cup can enhance the antenna's gain.

Figure 2:
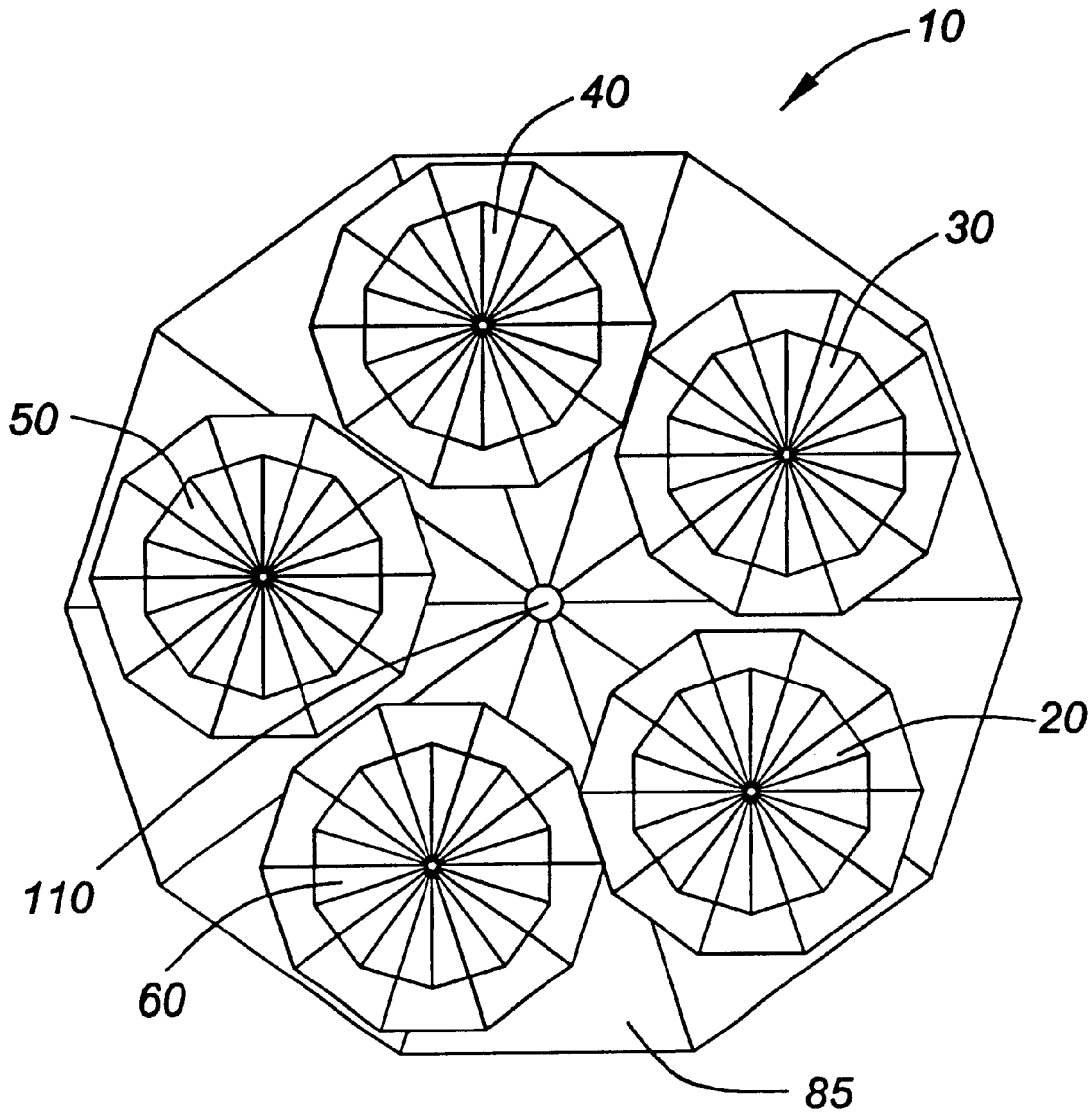
FIG. 2 is a top view of the pentagonal array of FIG. 1.

FIG. 2 is a top view of the antenna system 10 described in FIG. 1. Each mono-filar helical antenna element 20, 30, 40, 50, 60 is located at a separate vertex of a pentagon. The antenna elements 20, 30, . . . ,60 disposed in a pentagonal configuration have a higher aperture efficiency than that of a square configuration. In FIG. 2, the base platter 85 is clearly illustrated as having the shape of a polygon. However, other shape designs for the base platter 85 are possible such as either a circular or a rectangular shape. In use, the base platter 85 is a gimabaled support to achieve full coverage about the horizon.

Figure 3:
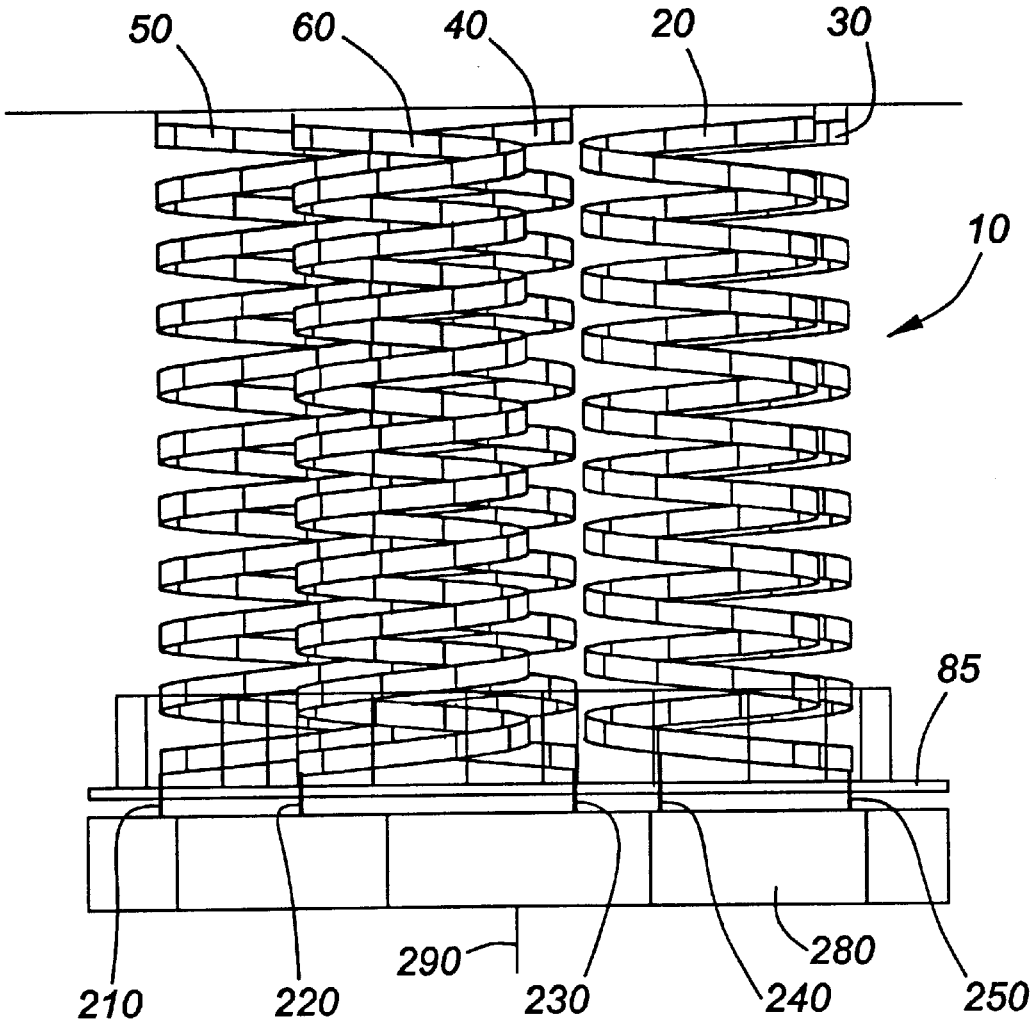
FIG. 3 is a side view of the pentagonal array of FIG. 1.
Figure 4:
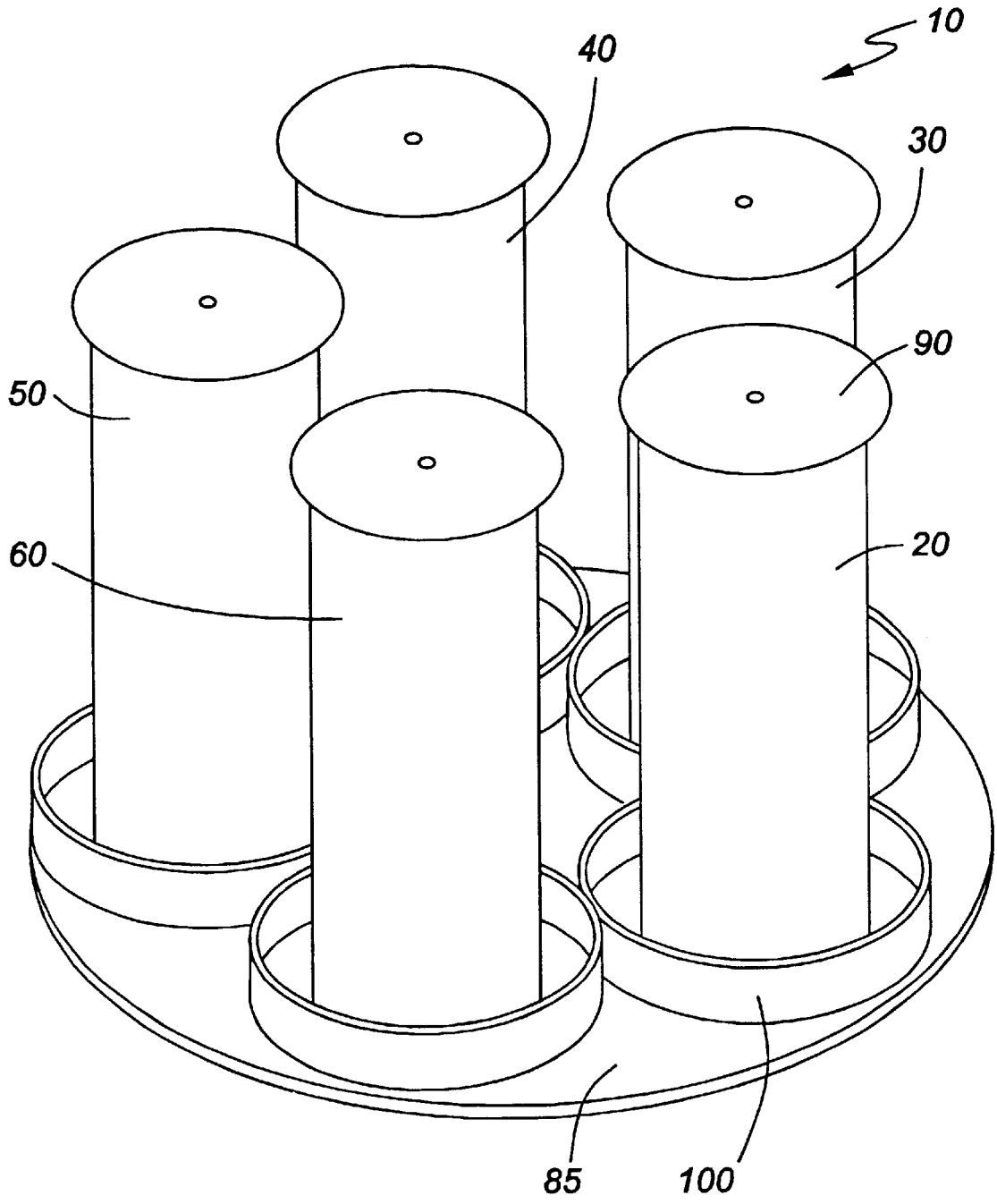
FIG. 4 is an isometric view of a pentagonal array of helical antennas with the helical filaments removed for clarity.

FIG. 3 is a side view of the antenna system 10 according to the present invention. The five helical antenna element feeds 210, 220, 230, 240, 250 are each connected to a filament belonging to one of the five helical antenna elements. A potential is applied across each element feed 210, 220, . . . , 250, essentially between the origin end of each feed 210, 220, . . . , 250 and the reflective base platter 85. In the event that the base platter 85 is not a reflector, then potential may be applied between each feed and its corresponding reflector cup.

In FIG. 3, a phasing/combining network 280 is connected to the origin end of each of the antenna element feeds 210, 220, . . . , 250. The phasing/combining network has an input port 290. The input port serves as an output port if the antenna is used as a receiver. A signal is applied to the input port 290 and divided into five independent signals by the phasing/combining network 280. The phasing/combining network 280 also appropriately shifts the phase of each of the five signals. The five signals are then fed to each of the five antenna element feeds 210, 220, . . . , 250 and subsequently their corresponding helical antenna element. The input power is also split five ways in order to excite the five antenna element feeds 210, 220, . . . , 250 and eventually the five filaments. The phasing/combining network excites the filaments by providing signals with uniform current amplitudes with phases of 0°, 72°, 144°, 216°, 288° or the polar opposite of these phases at each base end of the five helical antenna elements. The phasing/combining network may be a micro-strip, strip-line or other structure attached to either the front or the back of the reflective base platter.

FIG. 4 is an isometric view of the structure of the antenna system 10 according to the present invention with the helices removed to clarify the drawing. The antenna array has five antenna elements 20, 30, 40, 50, 60 disposed in a pentagonal configuration and supported on a base platter 85. The longitudinal axes of the five helical antenna elements 20, 30, 40, 50, 60 are substantially perpendicular to the planar surface of the base platter 85. The conductive planar surface of the base platter 85 provides a return path for currents provided at the base end of the filaments. The antenna element 20 has a conductive end-loading disc 90 at the terminal end of its filament winding (not shown). As an additional element, a reflector cup 100 is mounted on the base platter 85 at the base end of the antenna element 20. Each of the other four helical antenna elements 30, 40, 50, 60 are constructed and arranged in the same manner with both an end-loading disc and a reflector cup.

Figure 5:
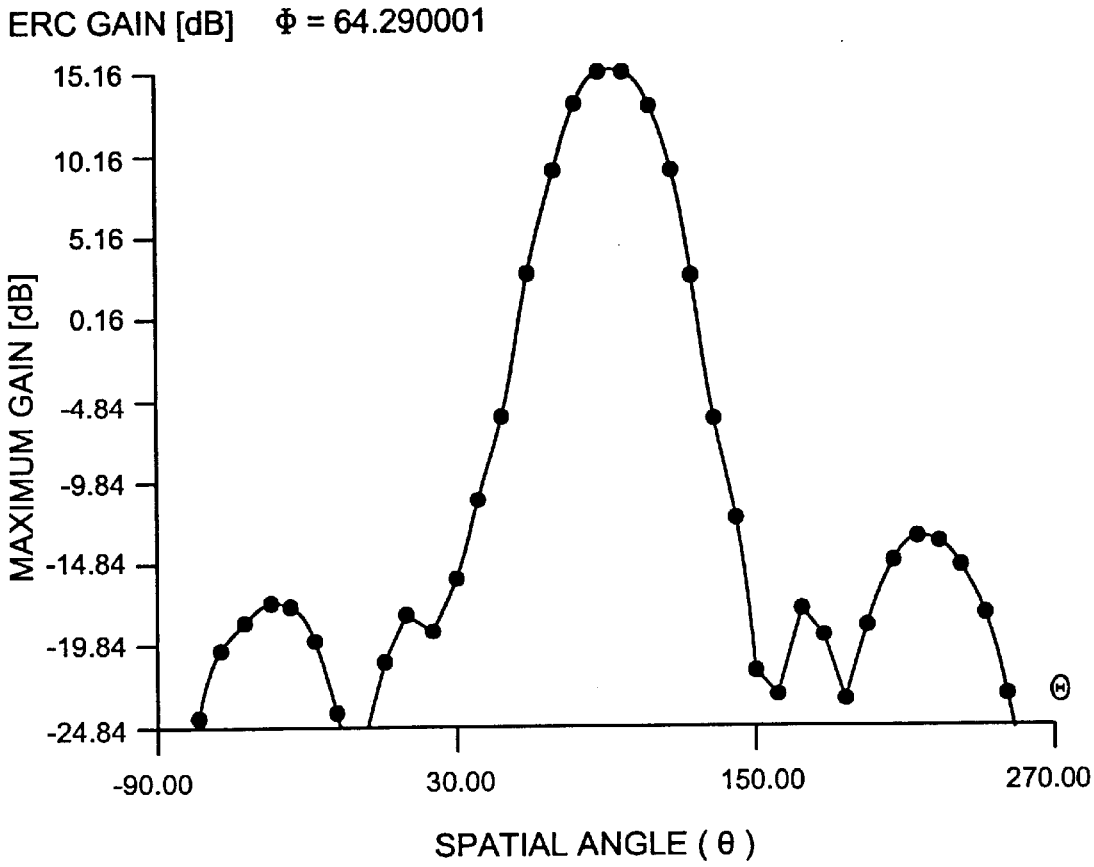
FIG. 5 is a graph showing a typical radiation pattern cut for the present invention.

FIG. 5 shows a graph representing the gain pattern of the antenna array of FIGS. 1–4. The graph shows a gain over the range from −900° to 270°. A gain of approximately 15 dB was achieved at center. In addition, numerical analysis demonstrates that the pentagonal array achieves higher gain than other conventional antennas such as square arrays of helices, reflector antennas, patch antennas or single helix elements. Of note is the fact that the pentagonal array has a higher aperture efficiency than a four element square array of helices having the same swept volume. The pentagonal array of helices can achieve unrivalled gain and very low noise temperature resulting in increased system capacity. This array also provides very low sidelobe levels as shown in FIG. 5, resulting in improved satellite discrimination relative to most other implementations.

While it is preferable to use helical antenna elements in a phased-array antenna, it is also conceivable that other antenna elements, such as reflector antennas or patch antennas, may be used.

A person understanding the above-described invention may now conceive of alternative designs, using the principles described herein. All such designs which fall within the scope of the claims appended hereto are considered to be part of the present invention.

What is claimed is:

1. An antenna system comprising:

a base;

five helical antenna elements mounted on said base, each antenna element having a base end and a terminal end and being located at a separate vertex of a pentagon, and each element further having an antenna element feed connected at the base end thereof; and a phasing/combining network for feeding input power to each antenna element feed;

wherein each of the elements is supported by the base at the base end of each antenna element.

2. An antenna system as defined in claim 1, wherein each helical antenna element is supported in a reflector cup, and the reflector cup is supported on the base.

3. An antenna system comprising:

a base having a planar surface;

five helical antenna elements mounted on said base with their helix axes orthogonal to the plane surface of the base, each of the helical antenna elements being located at a separate vertex of a pentagon, and each element having an antenna element feed located at a base end of the element; and a phasing/combining network for feeding input power to each antenna element.

4. An antenna system as defined in claim 3, wherein the planar surface is a reflective surface.

5. An antenna system as defined in claim 3, wherein the antenna system has an airborne application.

6. An antenna system comprising:

a base having a planar surface;

five multi-filar helical antenna elements mounted an said base with their helix axes orthogonal to the planar surface of the base, each of the elements being located at a separate vertex of a pentagon, each of the five multi-filar helical antenna elements having a feed network coupled to a base end thereof, and each feed network having a feed end located at the base end of a corresponding element; and a phasing/combining network for connecting the feed network of each element;

wherein each element is supported by the base at the base end of the element, and wherein the phasing/combining network feeds input power to the feed end of each feed network.

7. An antenna system as defined in claim 6, wherein the antenna system has an airborne application.

8. An antenna system comprising:

a base having a planar surface;

five helical antenna elements mounted on said base with their helix axis orthogonal to the planar surface of the base, each of the five helical antenna elements being located at a separate vertex of a pentagon, each of the five helical antenna elements being angularly displaced by 72° relative to its two adjacent elements, each of the five helical antenna elements having a feed network coupled to a base end of the helical antenna element, and each feed network having a feed end located at the base end of a corresponding helical antenna element, the feed network exciting the elements with relative phases of 0°, 72°, 144°, 216°, 288° or 0°, −72°, −144°, and −288°.

9. An antenna system as defined in claim 8, wherein the planar surface is a reflective surface.

* * * * *